US005921333A

United States Patent [19]

Hewitt

[11] Patent Number: 5,921,333

[45] Date of Patent: Jul. 13, 1999

[54] CASTING HAVING IN-SITU CAST INSERTS AND METHOD OF MANUFACTURING

[75] Inventor: Paul H. Hewitt, Angus, United Kingdom

[73] Assignee: Naco, Inc., Downers Grove, Ill.

[21] Appl. No.: 08/906,778

[22] Filed: Aug. 6, 1997

[51] Int. Cl.[6] ..... E21B 10/46

[52] U.S. Cl. ..... 175/432; 175/434

[58] Field of Search ..... 175/420.2, 426, 175/428, 432, 434

[56] References Cited

U.S. PATENT DOCUMENTS

| | | | |
|---|---|---|---|
| 1,616,626 | 2/1927 | Hughes . | |
| 2,874,429 | 2/1959 | Emter et al. . | |
| 2,890,318 | 6/1959 | Kruse . | |
| 2,890,915 | 6/1959 | Benham . | |
| 3,191,252 | 6/1965 | Webbere . | |
| 3,554,270 | 1/1971 | Gelfand . | |
| 3,638,978 | 2/1972 | Guntermann . | |
| 3,888,297 | 6/1975 | Davies . | |
| 4,339,009 | 7/1982 | Busby | 175/426 X |
| 4,454,205 | 6/1984 | Miller et al. . | |
| 4,621,674 | 11/1986 | Kaiser et al. . | |
| 5,238,046 | 8/1993 | Guerard . | |
| 5,248,006 | 9/1993 | Scott et al. | 175/432 X |
| 5,299,620 | 4/1994 | Revankar et al. . | |
| 5,337,801 | 8/1994 | Materkowski . | |
| 5,348,108 | 9/1994 | Scott et al. | 175/434 X |
| 5,381,850 | 1/1995 | Otte et al. . | |
| 5,431,239 | 7/1995 | Tibbitts et al. | 175/432 X |
| 5,439,750 | 8/1995 | Ravenhall et al. . | |
| 5,492,188 | 2/1996 | Smith et al. | 175/432 |

FOREIGN PATENT DOCUMENTS

| | | | |
|---|---|---|---|
| 353214A | 1/1990 | European Pat. Off. | 175/432 |

*Primary Examiner*—Frank Tsay
*Attorney, Agent, or Firm*—Lee, Mann, Smith, McWilliams, Sweeney & Ohlson

[57] ABSTRACT

A drill bit casting comprising a casting material, an insert having a base, a tip and a side wall surface, and a sleeve including a bottom wall, a peripheral side wall and a chamber formed within the side wall. The base of the insert is located within the chamber of the sleeve such that the peripheral side wall of the sleeve extends around and engages the side wall of the insert and such that the tip of the insert protrudes from the chamber beyond the side wall of the sleeve. The casting material is cast around and contacts the exterior surface of the sleeve. The sleeve insulates the insert from direct contact with the casting material such that the insert remains below its sinter temperature during the casting process.

22 Claims, 1 Drawing Sheet

CASTING HAVING IN-SITU CAST INSERTS AND METHOD OF MANUFACTURING

BACKGROUND OF THE INVENTION

The present invention is directed to a casting, such as a drill bit casting, including in-situ cast inserts and in particular to a casting wherein the insert is partially located within a sleeve member such that the sleeve member insulates the insert from direct contact with the casting material.

Previous attempts to form a casting with bare outwardly projecting in-situ cast tungsten carbide inserts have not been successful. The bare inserts were placed within a mold and a molten metal casting material was cast into the mold such that the casting material was in direct contact with the inserts. The interface between the steel casting material and the inserts was brittle. The inserts that remained intact after the solidification of the casting material shattered upon the application of shot blasting or other mechanical handling. This condition is thought to be due to brittle carbides at the boundaries of the interface between the insert and the casting material. The present invention provides a method for forming a casting having in-situ cast inserts that remain sound, intact and firmly in place through all post-casting processes, such as shot blasting and heat treatment.

SUMMARY OF THE INVENTION

A casting comprising one or more insert and sleeve assemblies cast in place with a casting material. Each insert and sleeve assembly includes an insert and a sleeve. The insert includes a tip and a base having a side wall surface. The sleeve includes a bottom wall, a peripheral side wall having an interior surface and an exterior surface, and a chamber formed within the side wall. The side wall includes a first end having an aperture providing access to the chamber and a second end attached to and enclosed by the bottom wall. The sleeve is heated and the base of the insert is placed within the chamber of the sleeve such that the peripheral side wall of the sleeve extends around and engages the side wall of the insert and such that the tip of the insert is located outwardly from the chamber beyond the first end of the sleeve. The sleeve is then cooled such that the side wall of the sleeve contracts and forms a shrink-fit attachment with the insert. The insert and sleeve assembly is placed into a mold having a cavity such that the tip of the insert is embedded in the mold and such that the side wall and bottom wall of the sleeve projects into the cavity of the mold. The molten casting material, such as steel, is cast into the cavity of the mold and extends around and contacts the exterior surface of the sleeve. The sleeve insulates the insert from direct contact with the molten casting material such that the temperature of the insert remains below the sinter temperature of the insert during the casting process. The tip of the insert projects outwardly from the casting material.

BRIEF DESCRIPTION OF THE DRAWING FIGURES

DETAILED DESCRIPTION OF THE PREFERRED EMBODIMENT

Figure 1:
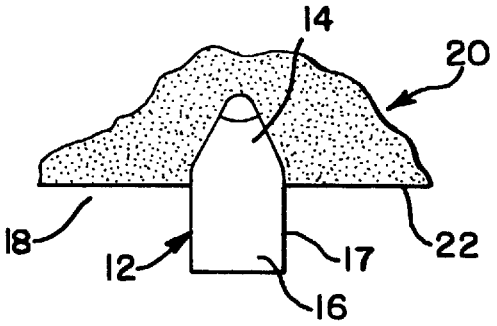
FIG. 1 PRIOR ART
FIG. 1 is a partial cross-sectional view of a bare insert having its tip embedded within a mold as practiced in the prior art.
Figure 2:
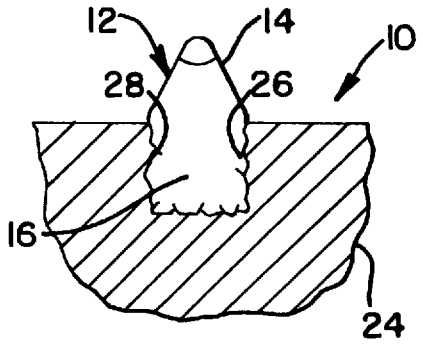
FIG. 2 PRIOR ART
FIG. 2 is a partial cross-sectional view of a prior art casting having a bare insert cast in a casting material.
Figure 3:
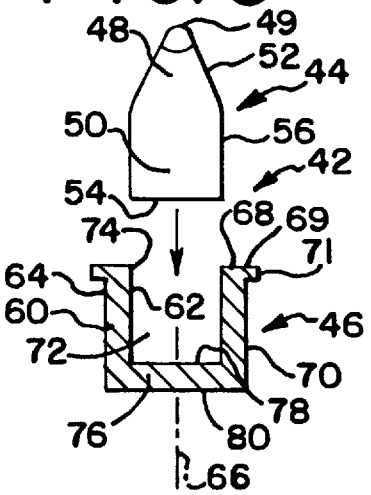
FIG. 3 is a cross-sectional exploded view of the insert and sleeve assembly of the present invention.

FIGS. 1 and 2 show a prior art method of forming a casting 10, such as a drill bit casting used in rock and earth drilling applications, having one or more cast in place outwardly projecting bare inserts 12. Each insert 12 includes a tip 14 and a base 16 having a side wall surface 17. The prior art casting 10 is formed by placing one or more tungsten carbide inserts 12 into the cavity 18 of a mold 20 such that the tip 14 of the insert 12 is embedded within the mold wall 22. As shown in FIG. 2, a casting material 24, such as steel, is cast in a molten state into the cavity 18 of the mold 20 such that the casting material 24 directly contacts the outer surface of the base 16 of the insert 12. The resulting interface 26 between the casting material 24 and the base 16 of the insert 12 includes a plurality of brittle cracks 28. The brittle cracks 28 in the interface 26 create an unsound insert 12 and lead to the shattering of the insert. 12 upon the application of a post-casting process such as shot blasting or heat treatment.

The present invention, as shown in FIGS. 3–6, overcomes the problems associated with the prior art method and resulting casting 10 as shown in FIGS. 1 and 2. The casting 40 of the present invention may comprise a drill bit casting as used in rock and earth drilling applications or other types of castings that include one or more projecting inserts. The casting 40 includes one or more insert and sleeve assemblies 42. Each insert and sleeve assembly 42 includes an insert 44 and a sleeve 46. The insert 44 includes a tip 48 having an outer end 49. The insert 44 also includes a base 50. The tip 48 is generally conical shaped and includes a generally conical surface 52. Alternatively, the tip 48 may be generally rhomboid-shaped, generally cylindrical-shaped, or other configurations as desired. The base 50 of the insert 44 includes a generally planar bottom wall surface 54 and a generally cylindrical side wall surface 56. The conical surface 52 extends outwardly from the side wall surface 56 of the base 50 and converges inwardly toward the outer end 49 of the tip 48.

The insert 44 is preferably formed from a tungsten carbide material, but may be formed from a polycrystalline diamond composite material, or other materials that may be useful to enhance the performance of the drill bit casting. The insert 44, when formed from a tungsten carbide material, has a sinter temperature of approximately 1,450° C. The side wall surface 56 of the insert 44 preferably has a diameter that may range from approximately five millimeters to approximately twenty-five millimeters. The insert 44 preferably has a height extending along its central longitudinal axis from the bottom wall surface 54 to the apex of the conical side wall 52 at the end 49 that may range from approximately eight millimeters to approximately forty millimeters.

The sleeve 46 of the insert and sleeve assembly 42 includes an annular and generally cylindrical peripheral side wall 60 having a generally cylindrical inner surface 62 and a generally cylindrical outer surface 64. The side wall 60 includes a central longitudinal axis 66 and extends parallel thereto from a first end 68 to a second end 70. The first end 68 of the side wall 60 forms a rim 69 having an overhang or lip 71 that extends outwardly from the outer surface 64 relative to the axis 66. The lip 71 extends in a generally circular manner around the outer surface 64. The lip 71 has a diameter that is larger than the diameter of the outer surface 64 of the side wall 60 by about one millimeter. Thus the lip 71 extends outwardly from the outer surface 64 by about one-half millimeter (0.5 mm). The lip 71 has a depth extending generally parallel to the axis 66 of about one-half millimeter. The sleeve 46 includes a hollow chamber 72 formed within the side wall 60. The rim 69 at the first end 68 of the side wall 60 forms an aperture 74 that provides access to the chamber 72. The second end 70 of the side wall 60 is attached to and enclosed by a generally planar bottom wall 76. The bottom wall 76 includes a generally circular and planar inner surface 78 and a generally circular and planar outer surface 80. The sleeve 46 is thereby generally cup-shaped. The sleeve 46 is preferably formed from a low carbon silicon steel having less than 0.2% carbon and approximately 0.5% to 1.00% silicon, which can be cast or wrought. The sleeve 46 has a melting point between approximately 1,460° C. and 1,520° C.

The internal diameter of the chamber 72 of the sleeve 46, which corresponds to the diameter of the inner surface 62 of the side wall 60, is preferably slightly shorter than the diameter of the side wall surface 56 of the base 50 of the insert 44 when the insert 44 and sleeve 46 are both at approximately ambient or room temperature. Preferably the internal diameter of the chamber 72 of the sleeve 46 is approximately equal to 0.999 times the diameter of the side wall surface 56 of the insert 44 when the insert 44 and sleeve 46 are both at approximately ambient temperature. The side wall 60 of the sleeve 46 has a thickness between the inner surface 62 and outer surface 64 preferably ranging from approximately two millimeters to approximately three millimeters. The thickness of the bottom wall 76 of the sleeve 46 between the inner surface 78 and the outer surface 80 also preferably ranges from approximately two millimeters to approximately three millimeters. The height of the chamber 72 from the inner surface 78 of the bottom wall 76 to the rim 69 at the first end 68 of the side wall 60 is preferably equal to approximately one-half of the height of the insert 44 from the bottom wall surface 54 at the base 50 to the end 49 of the tip 48. For example, an insert 44 having a total height of approximately twenty-four millimeters is preferably used with a sleeve 46 having a chamber 72 with a height of approximately twelve millimeters. The height of the side wall surface 56 of the base 50 of the insert 44 is preferably longer than the height of the chamber 72.

The insert and sleeve assembly 42 is formed by heating the sleeve 46 to at least 300° C. or higher to expand the side wall 60 and increase the diameter of the chamber 72, while the insert 44 is maintained at approximately ambient temperature, such that the increased diameter of the chamber 72 is slightly larger than the diameter of the base 50 of the insert 44. The base 50 of the insert 44 is then inserted through the aperture 74 and into the chamber 72 of the sleeve 46 until the bottom wall surface 54 of the insert 44 engages, or is located closely adjacent to, the inner surface 78 of the bottom wall 76 of the sleeve 46. The insert 44 projects outwardly from the chamber 72 and extends beyond the first end 68 and rim 69 of the side wall 60 such that the tip 48 of the insert 44 is located outside of the chamber 72 and beyond the first end 68 and rim 69 of the side wall 60. The sleeve 46 is then allowed to cool such that the side wall 60 of the sleeve 46 shrinks and contracts around the side wall surface 56 of the insert 44. The inner surface 62 of the side wall 60 thereby engages and grips the side wall surface 56 of the base 50 of the insert 44. The insert 44 is thereby held in place within the chamber 72 of the sleeve 46 by a friction connection between the inner surface 62 of the side wall 60 and the side wall surface 56 of the base 50 of the insert 44. The attachment mechanism between the insert 44 and sleeve 46 is a solid-to-solid connection between the solid side wall 60 of the sleeve 46 and the solid base 50 of the insert 44.

Figure 4:
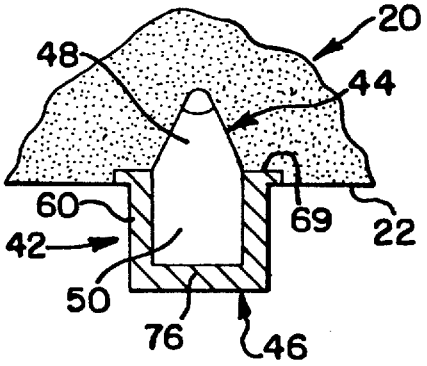
FIG. 4 is a cross-sectional view showing the insert and sleeve assembly placed within a mold for in-situ casting.
Figure 5:
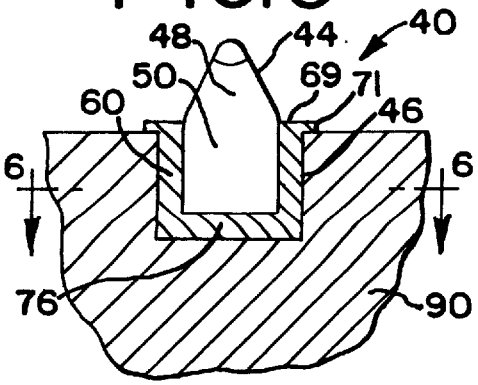
FIG. 5 is a partial cross-sectional view of the casting of the present invention.
Figure 6:
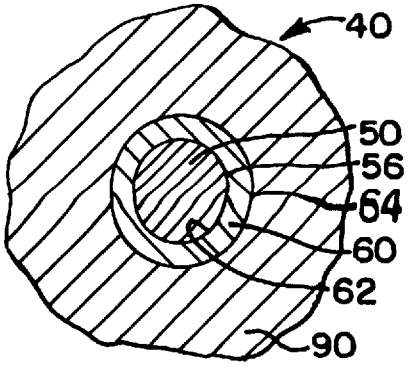
FIG. 6 is a cross-sectional view taken along lines 6—6 of FIG. 5.

As shown in FIG. 4, one or more insert and sleeve assemblies 42 are placed within the cavity 18 of the mold 20. The tip 48 of the insert 44 is inserted into the wall 22 of the mold 20 such that the tip 48 is embedded within the mold 20. The first end 68, rim 69 and lip 71 of the side wall 60 of the sleeve 46 abut and engage the mold wall 22 and may be slightly embedded within the mold wall 22. The rim 69 facilitates improved placement of the insert and sleeve assembly 42 within the cavity 18 of the mold 20. As shown in FIG. 4, once the insert 44 is embedded within the mold wall 22, the insert 44 is completely enclosed by the mold wall 22 and the sleeve 46. The insert and sleeve assemblies 42 are held in place within the cavity 18 of the mold 20 as a substantially integral part of the mold prior to casting.

A casting material 90 is cast in a molten condition into the cavity 18 of the mold 20 in a conventional casting operation such that the casting material 90 surrounds and contacts the outer surface 64 of the side wall 60 and the outer surface 80 of the bottom wall 76 of the sleeve 46. The casting material 90 is preferably a low alloy steel having a total alloy content of approximately five percent by weight. The alloys in the steel casting material 90 comprise manganese, nickel, chromium and molybdenum. The casting material 90 has a melting/solidification point of approximately 1,460° C. to approximately 1,520° C. The casting material 90 is cast in a molten state at approximately 1,550° C. to 1,580° C. The sleeve 46 insulates the insert 44 from direct contact with the molten casting material 90. The insert 44 remains below its sinter temperature of approximately 1,450° C. throughout the entire casting process.

After casting of the casting material 90, the casting material 90 is allowed to cool and solidify. The resulting casting 40 includes sound inserts 44 that are held firmly in place by the casting material 90 and sleeves 46 and that remain sound and firmly held in place after post-casting processes, such as shot blasting and heat treatment.

During the casting of the casting material 90 around the sleeve 46, some melting and chemical diffusion of the sleeve material will take place at the interface between the sleeve 46 and the casting material 90 resulting in a liquid to solid attachment mechanism between the molten liquid casting material 90 and the solid portion of the sleeve 46. The sleeve 46 and the casting material 90 both have a melting/solidification point of approximately 1,460° C. to 1,520° C. The sleeve 46 and casting material 90 also have approximately the same thermal coefficient of linear expansion and elastic modulus.

At the solid-to-solid interface attachment mechanism between the sleeve 46 and insert 44, a double contraction helps keep the insert 44 in place within the sleeve 46. The double contraction comprises the first shrink fit contraction caused by the cooling of the heated sleeve 46 after the insert 44 is inserted into the chamber 72 of the sleeve 46. The second shrink fit contraction of the sleeve 46 about the insert 44 is caused by the subsequent heating of the sleeve 46 by the molten casting material 90 and the subsequent cooling of the sleeve 46. The thermal coefficient of linear expansion of the insert 44 is approximately 0.33 times that of the sleeve 46 and the casting material 90. Therefore, there are no residual tensile stresses at the insert 44/sleeve 46 interface through all of the process steps, and only compressive stresses are present. The elastic modulus of the insert 44 is approximately twice as large as that of the sleeve 46 and casting material 90. This helps the insert 44 to withstand high residual stresses at the insert 44/sleeve 46 interface.

Various features of the invention have been particularly shown and described in connection with the illustrated embodiment of the invention, however, it must be understood that these particular arrangements merely illustrate, and that the invention is to be given its fullest interpretation within the terms of the appended claims.

What is claimed is:

1. A casting comprising:

an insert having a tip and a base, said base having a side wall surface;

a sleeve including a bottom wall, a peripheral side wall having an interior surface and an exterior surface, a chamber formed within said side wall, and a lip extending outwardly from said outer surface of said side wall, said side wall including a first end having an aperture and a second end attached to said bottom wall, said lip being located at said first end of said side wall, said base of said insert being located within said chamber of said sleeve such that said peripheral side wall of said sleeve extends around and engages said side wall surface of said insert, said insert extending outwardly from said chamber through said aperture beyond said first end of said sleeve; and a casting material extending around and integrally fused with said exterior surface of said sleeve, said sleeve insulating said insert from direct contact with said casting material, said tip of said insert located outwardly from said casting material.

2. The casting of claim 1 wherein said said side wall and said lip form a generally planar rim that extends around said aperture at said first end of said side wall.

3. The casting of claim 1 wherein said side wall of said sleeve is generally cylindrical.

4. The casting of claim 3 wherein said side wall of said sleeve has a thickness of between approximately two millimeters and approximately three millimeters.

5. The casting of claim 1 wherein said base of said insert has a diameter of between approximately five millimeters and approximately twenty-five millimeters.

6. The casting of claim 1 wherein said side wall of said sleeve extends from a bottom wall surface of said base of said insert toward said tip of said insert approximately one-half of the height of said insert from said bottom wall surface of said insert to an outer end of said tip of said insert.

7. The casting of claim 1 wherein said insert is formed from a tungsten carbide material.

8. The casting of claim 1 wherein said insert is formed from a polycrystalline diamond composite material.

9. The casting of claim 1 wherein said sleeve is formed from a low carbon silicon steel.

10. The casting of claim wherein said casting material is formed from a low alloy steel.

11. The casting of claim 1 wherein said casting comprises a drill bit casting for rock and earth drilling applications.

12. An insert and sleeve assembly for use with a casting material to form a casting, said insert and sleeve assembly comprising:

an insert having a tip and a base, said base having a side wall surface; and a sleeve including a bottom wall, a peripheral side wall having an interior surface and an exterior surface, a chamber formed within said side wall, and a lip extending outwardly from said outer surface of said side wall, said side wall including a first end having an aperture and a second end attached to said bottom wall, said lip being located at said first end of said side wall, said base of said insert being located within said chamber of said sleeve such that said peripheral side wall of said sleeve extends around and engages said side wall surface of said insert, said insert extending outwardly from said chamber through said aperture beyond said first end of said sleeve.

13. A method of forming a casting including one or more projecting inserts, said method comprising the steps of:

providing an insert having a tip and a base, said base including a side wall surface;

providing a sleeve having a bottom wall and a peripheral side wall having a first end and a second end, said side wall forming a chamber that is open at said first end of said side wall and closed at said second end of said side wall by said bottom wall of said sleeve;

inserting said base of said insert into said chamber of said sleeve such that said base of said sleeve is located within said chamber to form an insert and sleeve assembly wherein said side wall of said sleeve engages said side wall surface of said insert and said tip of said insert is located outside of said chamber;

inserting said insert and sleeve assembly into a mold having a cavity such that said tip of said insert is embedded in said mold and such that said side wall and said bottom wall of said sleeve projects into the cavity of the mold; and casting a molten casting material into the cavity of the mold such that said casting material extends around and in contact with said side wall and said bottom wall of said sleeve, said sleeve and the mold insulating said insert from direct contact with said casting material.

14. The method of claim 13 wherein said sleeve is heated to a predetermined temperature above ambient temperature prior to inserting said insert into said chamber of said sleeve.

15. The method of claim 14 wherein said sleeve is heated to at least approximately 300° C. prior to inserting said insert into said sleeve.

16. The method of claim 14 wherein said insert is at approximately ambient temperature when said insert is inserted into said heated sleeve.

17. The method of claim 14 wherein said chamber of said sleeve has a diameter that is smaller than the diameter of said side wall surface of said base of said insert when said insert and said sleeve are at ambient temperature and prior to the heating of said sleeve and the insertion of said insert into said chamber of said sleeve.

18. The method of claim 17 wherein said chamber of said sleeve has a diameter equal to approximately 0.999 times the diameter of said side wall surface of said insert when said insert and said sleeve are both at ambient temperature prior to the heating of said sleeve and the insertion of said insert into said chamber.

19. The method of claim 13 wherein the temperature of said insert remains below its sinter temperature during casting of the casting material.

20. The method of claim 19 wherein said casting material is cast at approximately 1550° C. to approximately 1580° C.

21. The method of claim 20 wherein said insert has a sinter temperature of approximately 1450° C.

22. The method of claim 20 wherein said sleeve has a melting point of between approximately 1460° C. and approximately 1520° C.

* * * * *